US005621989A

United States Patent [19]

Hensel et al.

[11] Patent Number: 5,621,989

[45] Date of Patent: Apr. 22, 1997

[54] STEAM VALVE SEAL FOR IRON

[75] Inventors: Keith J. Hensel, North Sydney; Richard L. Hoare, Neutral Bay, both of Australia

[73] Assignee: Sunbeam Products, Inc., Fort Lauderdale, Fla.

[21] Appl. No.: 557,305

[22] Filed: Nov. 14, 1995

[51] Int. Cl.[6] ..... D06F 75/18

[52] U.S. Cl. ..... 38/77.8; 277/15

[58] Field of Search ..... 38/77.8, 77.83, 38/77.7, 77.82, 77.5; 219/245, 252; 277/112, 15, 70, 101

[56] References Cited

U.S. PATENT DOCUMENTS

| | | | |
|---|---|---|---|
| 2,618,875 | 11/1952 | Vieceli | 38/77.81 |
| 2,887,799 | 5/1959 | Kuhn et al. | 38/77.83 |
| 3,593,441 | 7/1971 | Denton | 38/77.83 |
| 3,599,357 | 8/1971 | Gronwick et al. | 38/77.5 |
| 3,811,208 | 5/1974 | Vieceli et al. | 38/77.8 |
| 4,016,663 | 4/1977 | Cline et al. | 38/77.83 |
| 4,070,773 | 1/1978 | Gowdy | 38/77.83 |
| 4,079,528 | 3/1978 | Lindstaedt et al. | 38/77.83 |
| 4,109,136 | 8/1978 | Balchunas | 219/252 |
| 4,130,954 | 12/1978 | Walker | 38/77.83 |
| 4,196,340 | 4/1980 | Evans, Jr. et al. | 219/245 |
| 4,398,364 | 8/1983 | Augustine et al. | 38/77.5 |
| 4,567,679 | 2/1986 | Kraft et al. | 38/77.82 |
| 4,760,658 | 8/1988 | Emig et al. | 38/77.7 |
| 4,782,608 | 11/1988 | Petrik | 38/77.83 |
| 4,870,763 | 10/1989 | Campbell | 38/77.7 |
| 4,910,895 | 3/1990 | Rethmeier et al. | 38/77.83 |
| 5,038,501 | 8/1991 | Hipp et al. | 38/77.5 |
| 5,138,778 | 8/1992 | Brandolini | 38/77.8 |

FOREIGN PATENT DOCUMENTS

| | | | |
|---|---|---|---|
| 1931848 | 3/1978 | Germany | 38/77.8 |
| 1162991 | 7/1986 | Japan | 38/77.8 |
| 3115598 | 5/1988 | Japan | 38/77.8 |

*Primary Examiner*—Ismael Izaguirre

*Attorney, Agent, or Firm*—Paul D. Bangor, Jr.; Michael J. Kline; Carol I. Bordas

[57] ABSTRACT

A steam valve seal for a steam iron comprising: a hollow cylindrical base disposed within an opening defined by a steam chest cover plate of the iron, the base receiving a steam valve of the iron; an annular middle portion disposed between the base and an outer annular wall having a downwardly extending annular shoulder; the annular shoulder disposed in an annular channel defined by the steam chest cover plate; and an annular groove defined by and disposed between the annular middle portion and the outer annular wall, the annular groove receiving an annular clip disposed within the iron which holds the seal against the steam chest cover plate. Shrinkage of the steam valve seal causes the cylindrical base to tighten against the steam valve and causes the annular middle portion and annular shoulder to tighten against the steam chest cover plate.

6 Claims, 5 Drawing Sheets

STEAM VALVE SEAL FOR IRON

FIELD OF THE INVENTION

This invention relates to a steam valve seal for a steam pressing iron or the like, and more particularly, in a preferred embodiment, to an improved seal that shrinks against, instead of away from, the steam chest cover and the steam valve so that the useful life of the seal is increased.

BACKGROUND OF THE INVENTION

Typical steam valve seals for steam pressing irons shrink when exposed to high temperatures generated in steam irons over long periods of time. Further, the design of known steam valve seals are such that when such shrinkage occurs, the seals actually shrink away from the steam chest cover plate and the steam valve, causing the seal to fail thereby allowing steam to escape from the steam chest. As a result, the useful lives of the steam irons in which such known steam valve seals are used are shortened.

Thus, there is a need for an improved steam valve seal which eliminates the undesirable effects of shrinkage associated with known steam valve seals.

It is desirable, therefore, to provide an improved steam valve seal which shrinks against, as opposed to away from, the steam chest cover plate and the steam valve.

It is also desirable to provide an improved steam valve seal which has a longer life than known steam valve seals.

SUMMARY OF THE INVENTION

The present invention provides a novel steam valve seal for a steam iron comprising: a hollow cylindrical base disposed within an opening defined by a steam chest cover plate of the iron, the base receiving a cylindrical valve seat of the steam valve of the iron; an annular middle portion disposed between the base and an outer annular wall having a downwardly extending annular shoulder; the annular shoulder disposed in an annular channel defined by the steam chest cover plate; and an annular groove defined by and disposed between the annular middle portion and the outer annular wall, the annular groove receiving an annular clip disposed within the iron which holds the seal against the steam chest cover plate. Any shrinkage of the steam valve seal causes the cylindrical base to tighten against the valve seat and causes the middle portion and annular shoulder to tighten against the steam chest cover plate.

A better understanding of the present invention, its uses and other advantages, may be obtained from consideration of the following detailed description of the preferred embodiments and the claims appended hereto, particularly when read in conjunction with the appended drawings, a brief description of which now follows.

BRIEF DESCRIPTION OF THE DRAWINGS

In the accompanying drawings, the preferred embodiments of the invention and preferred methods of practicing the invention are illustrated in which.

DETAILED DESCRIPTION OF THE PREFERRED EMBODIMENTS

This invention is described with respect to the preferred physical embodiments constructed in accordance herewith. It will be apparent to those of ordinary skill in the art that various modifications and improvements may be made without departing from the scope and spirit of the invention. Accordingly, the invention is not limited by the specific embodiments illustrated and described, but only by the scope of the appended claims, including all equivalents thereof.

Figure 1:
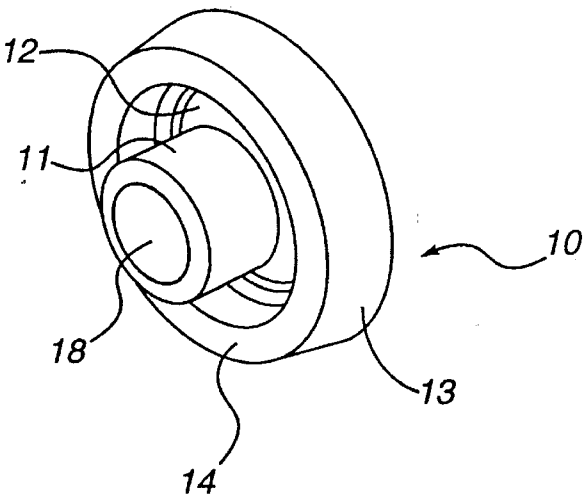
FIG. 1 is a bottom perspective view of the steam valve seal of the present invention.
Figure 2:
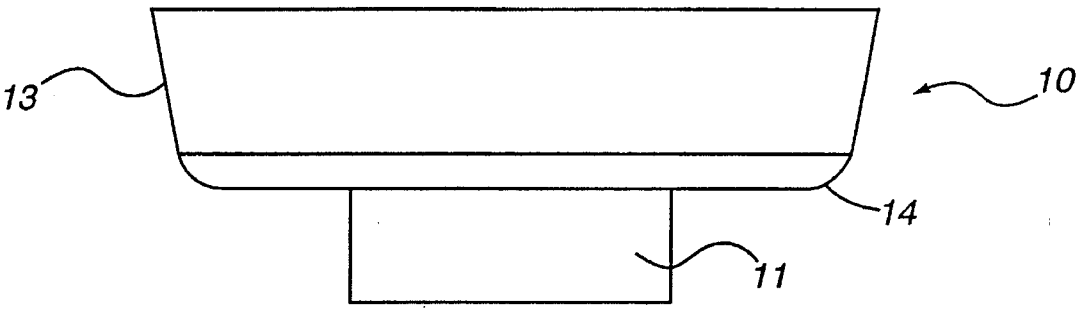
FIG. 2 is a front elevational view of the steam valve seal of the present invention.
Figure 3:
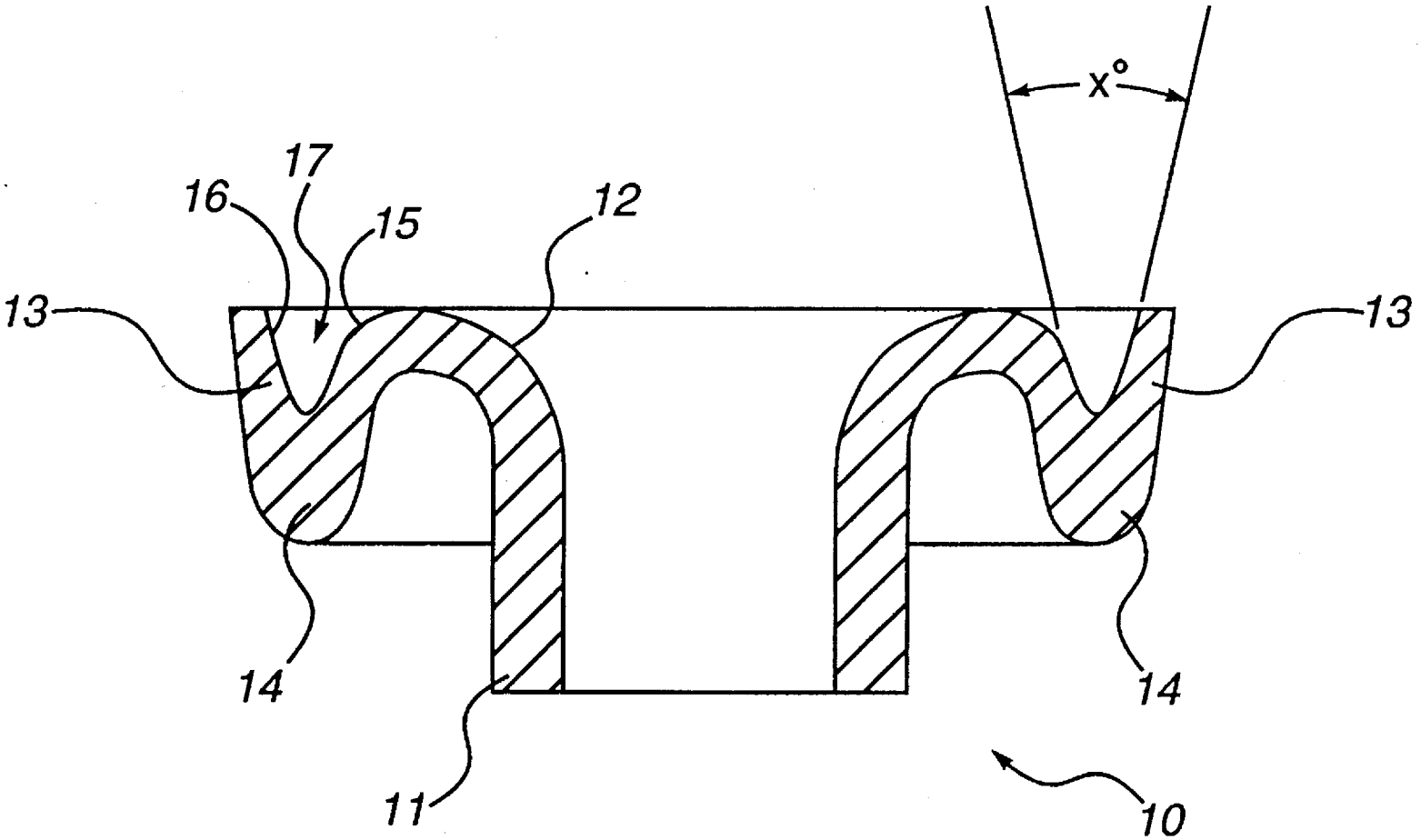
FIG. 3 is a cross-sectional view of the steam valve seal of the present invention.
Figure 4:
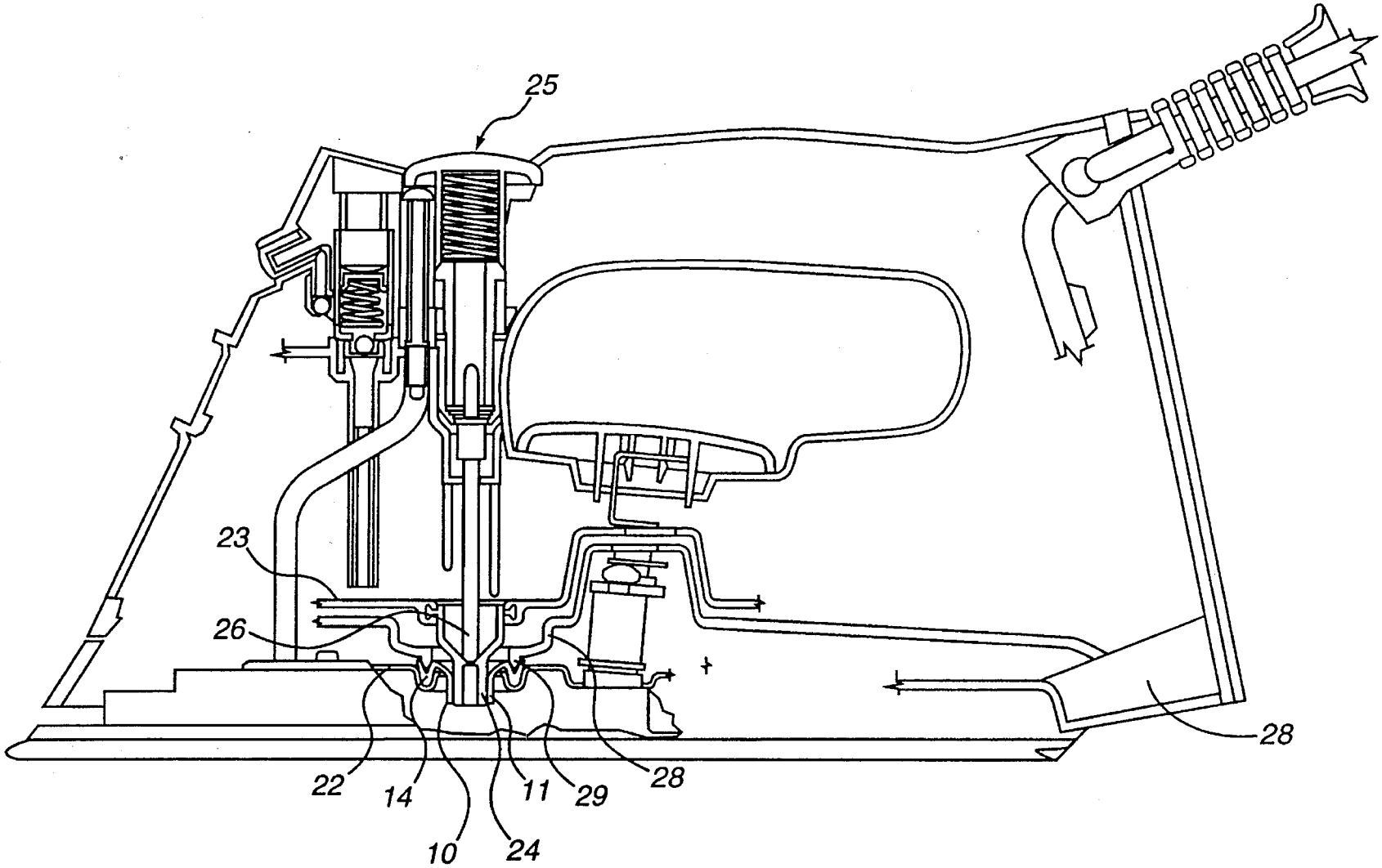
FIG. 4 is a cross-sectional view of an iron incorporating the steam valve seal of the present invention.
Figure 5:
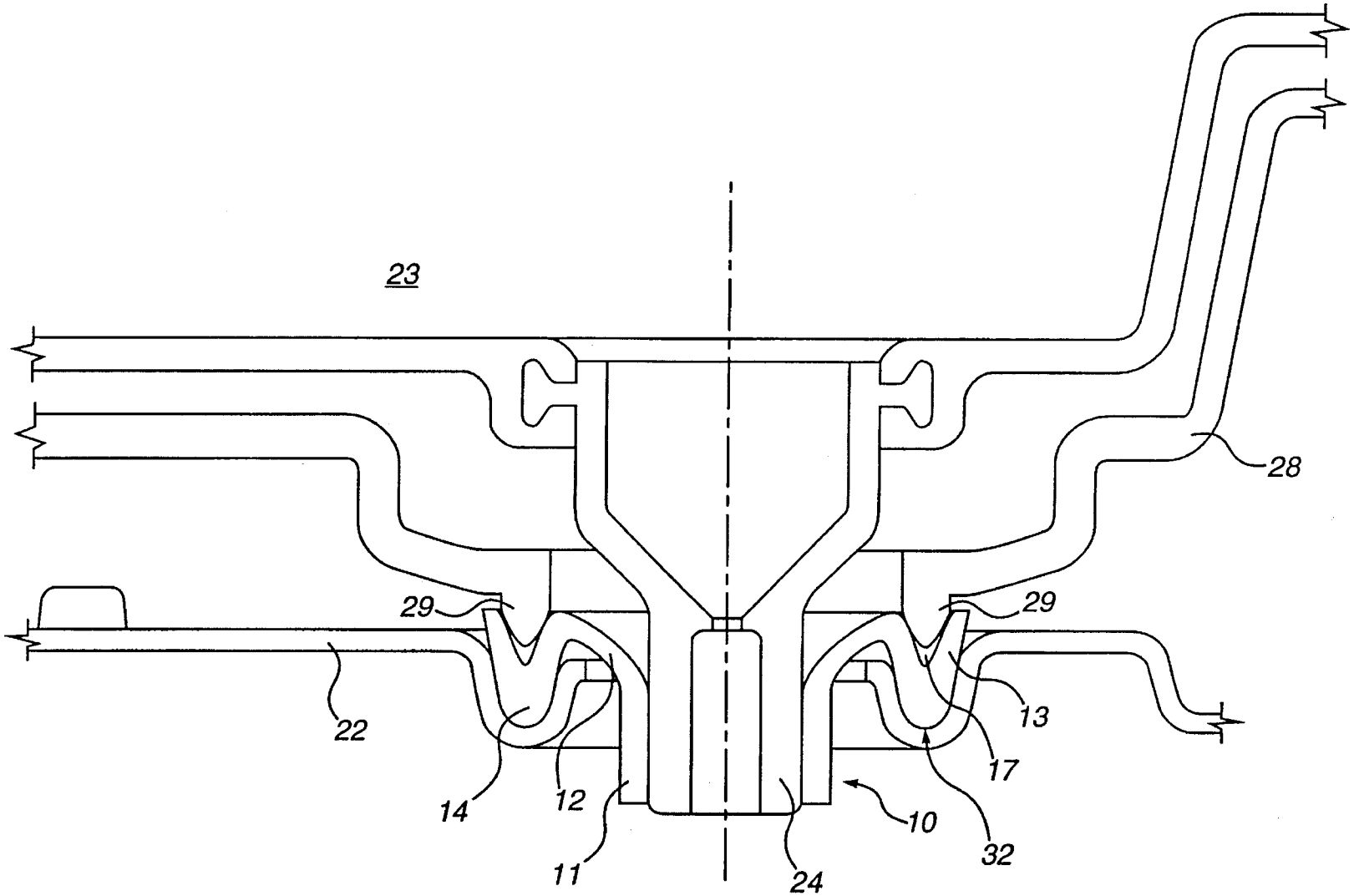
FIG. 5 is a partial cross-sectional view of the iron of FIG. 4 illustrating the steam valve seal of the present invention in greater detail.

The steam valve seal 10 of the present invention is shown in FIGS. 1–6. As shown therein, the steam valve seal 10 comprises a hollow cylindrical base 11. The top of the base 11 flares radially outward to form an annular middle portion 12 of the valve seal 10. As shown in FIGS. 3 and 5, the middle portion 12 is curved in a convex manner. Integrally formed with the middle portion 12 are an outer annular wall 13 and a downwardly extending annular shoulder 14. Preferably, the steam valve seal 10 of the present invention is made of a high temperature silicone rubber compound.

As shown in FIG. 3, the outer annular face 15 of the middle portion 12 and the inner annular face 16 of the outer annular wall 13 define an annular groove 17. The annular groove 17 completely circumscribes the middle portion 12. Preferably, the angle, x°, between the outer annular face 15 of the middle portion 12 and the inner annular face 16 of the wall 13 is about 40°.

Figure 6:
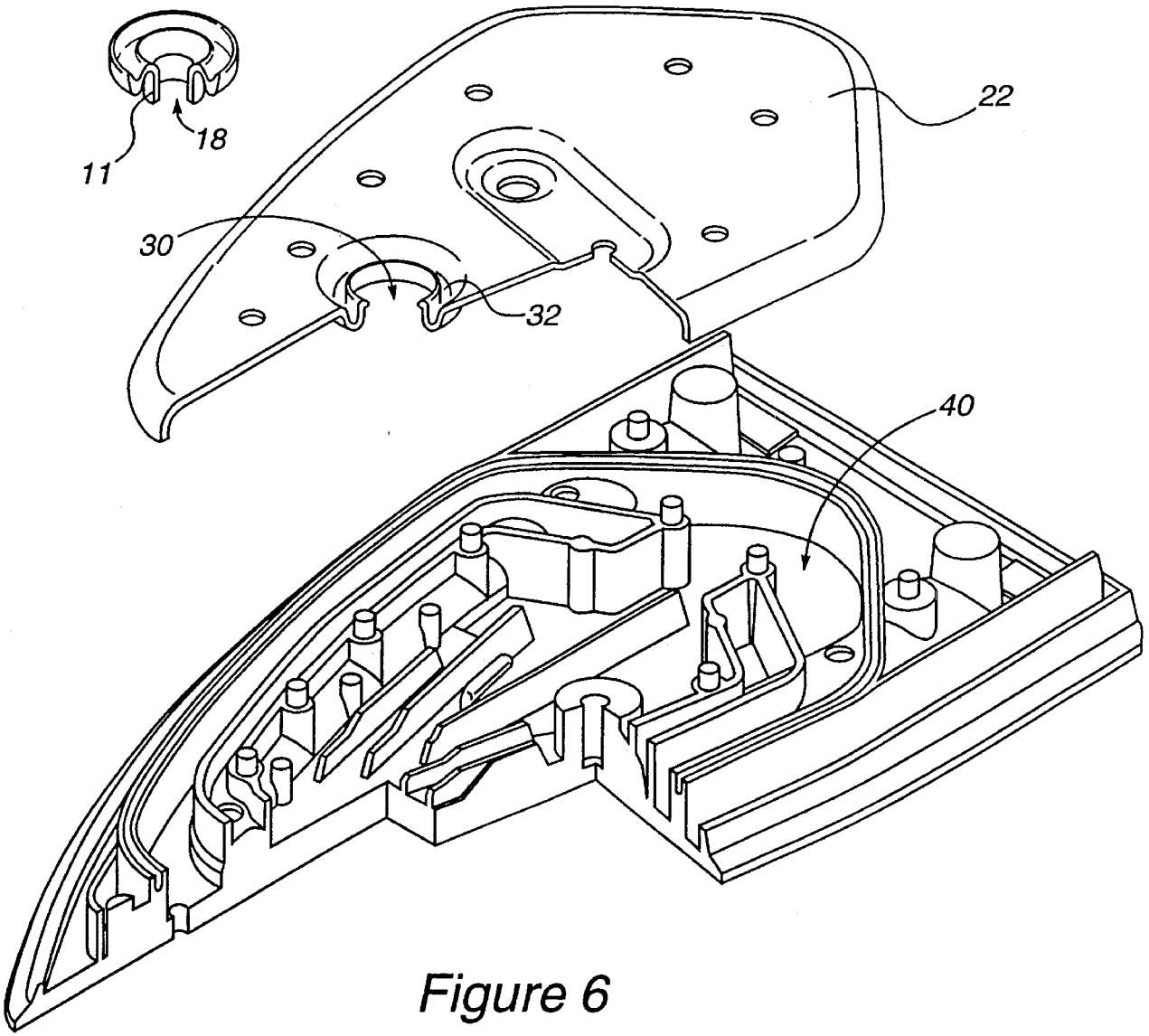
FIG. 6 is a partial exploded, partial cross-sectional view of the iron of FIG. 4 illustrating the position of the steam valve seal of the present invention.

As shown in FIGS. 4 and 5, the steam valve seat 24 of iron 20 is preferably integrally molded with the bottom of the water tank 23. The stem 26 of the steam valve 25 is seated in the steam valve seat 24. Referring to FIGS. 4–6, the steam valve seal 10 is disposed within iron 20 between the steam chest cover plate 22 and the steam valve seat 24. As shown in FIG. 6, the steam chest cover plate 22 defines an opening 30 through which the steam valve seat 24 and stem 26 extend into communication with the steam chest 40. The cylindrical base 11 of the steam valve seal 10 also extends through the opening 30 and receives the cylindrical valve seat 24 of the steam valve 25.

The steam chest cover plate 22 further defines an annular channel 32 concentrically arranged with respect to the opening 30. As shown in FIGS. 4–6, the downwardly extending annular shoulder 14 of the steam valve seal 10 is preferably disposed within the annular channel 32 in the steam chest cover plate 22. The steam valve seal 10 is held firmly in place against the steam chest cover plate 22 by an annular clip 29 disposed on the bottom of the iron skirt 28. The annular clip 29 is received and disposed in the annular groove 17 of the steam valve seal 10.

Unlike known steam valve seals which tend to fail due to shrinkage, the integrity of the steam valve seal 10 of the present invention remains in tact because the seal 10 actually shrinks against the steam chest cover plate 22 and the steam valve seat 24. When shrinkage of the seal 10 occurs, the diameter of the cylindrical opening 18 defined by base 11 is reduced. Thus, base 11 shrinks against the cylindrical valve seat 24 disposed therein. In addition, the dimensions of the middle portion 12 and of the annular shoulder 14 also decrease when the seal 10 shrinks, thereby pulling the middle portion 12 and the annular shoulder 14 against the steam chest cover plate 22 to maintain the integrity of the seal 10. As a result, the useful life of the steam valve seal 10 is lengthened compared to known steam valve seals.

Although the invention has been described in detail in the foregoing for the purposes of illustration, it is to be understood that such detail is solely for that purpose and that variations can be made therein by those of ordinary skill in the art without departing from the spirit and scope of the invention as defined by the following claims, including all equivalents thereof.

We claim:

1. A steam valve seal for a steam iron comprising:

a hollow cylindrical base;

an annular middle portion disposed between the base and an outer annular wall having a downwardly extending annular shoulder; and an annular groove defined by and disposed between the annular middle portion and the outer annular wall.

2. The steam valve seal of claim 1 wherein the annular middle portion is convex.

3. A steam valve seal for a steam iron comprising:

a hollow cylindrical base;

an annular middle portion disposed between the base and an outer annular wall having a downwardly extending annular shoulder; and an annular groove defined by and disposed between the annular middle portion and the outer annular wall wherein the annular middle portion defines an outer annular face and the outer annular wall defines an inner annular face and the angle between the outer annular face and the inner annular face is about 40°.

4. A steam valve seal for a steam iron comprising:

a hollow cylindrical base disposed within an opening defined by a steam chest cover plate of the iron, the base receiving a steam valve of the iron;

an annular middle portion disposed between the base and an outer annular wall having a downwardly extending annular shoulder; the annular shoulder disposed in an annular channel defined by the steam chest cover plate; and an annular groove defined by and disposed between the annular middle portion and the outer annular wall, the annular groove receiving an annular clip disposed within the iron which holds the seal against the steam chest cover plate.

5. The steam valve seal of claim 4 wherein shrinkage of the steam valve seal causes the cylindrical base to tighten against the steam valve and causes the annular middle portion and annular shoulder to tighten against the steam chest cover plate.

6. The steam valve seal of claim 4 wherein the annular clip is disposed on an underside of a skirt of the iron.

* * * * *